United States Patent [19]

Lewis

[11] Patent Number: 5,042,473

[45] Date of Patent: Aug. 27, 1991

[54] DEMAND VALVE FOR A RESPIRATOR

[75] Inventor: Ralph D. Lewis, Buchanan, Mich.

[73] Assignee: Pro-Tech Respirators, Inc., Buchanan, Mich.

[21] Appl. No.: 480,436

[22] Filed: Feb. 15, 1990

[51] Int. Cl.[5] ..... A62B 9/02

[52] U.S. Cl. ..... 128/205.24; 128/204.26

[58] Field of Search ..... 128/204.26, 205.24

[56] References Cited

U.S. PATENT DOCUMENTS

| | | | |
|---|---|---|---|
| 2,878,807 | 3/1959 | Gagnan | 128/204.26 |
| 3,095,890 | 7/1963 | Cousteau et al. | 128/204.26 |
| 3,595,226 | 7/1971 | Newcombe | 128/204.26 |
| 4,002,166 | 1/1977 | Oliver | 128/204.26 |
| 4,066,076 | 1/1978 | Williamson | 128/204.26 |
| 4,076,041 | 2/1978 | Christianson | 128/204.26 |
| 4,214,580 | 7/1980 | Pedersen | 128/204.26 |
| 4,437,460 | 3/1984 | Glynn | 128/205.24 |
| 4,676,238 | 6/1987 | Wetzel et al. | 128/204.26 |
| 4,693,242 | 9/1987 | Biard | 128/204.26 |
| 4,889,115 | 12/1989 | Bozano | 128/204.26 |

*Primary Examiner*—Aaron J. Lewis

*Attorney, Agent, or Firm*—James D. Hall

[57] ABSTRACT

A demand valve for a respirator. A fixed tube directs pressurized air flow from the source into an opening for a mask. The venturi effect caused by directed air flow through the housing acts to draw the diaphragm toward the respirator face mask. A portion of the air directed by the tube escapes and is directed over the tube by a hinged three sided arm. Air flow so directed by the arm creates a low pressure area within the arm thus pulling the arm toward the tube. The arm is in engagement with the stem of an air valve which when the arm is drawn toward the tube opens the valve to provide continued air flow into the mask without continued effort on the user's behalf.

7 Claims, 4 Drawing Sheets

DEMAND VALVE FOR A RESPIRATOR

FIELD OF THE INVENTION

This invention relates to a demand valve for a respirator and will have specific relevance to an improved demand valve for a respirator.

BACKGROUND OF THE INVENTION

The function of a demand value is to feed compressed air to the mask wearer at the proper pressure and flow to exactly reflect his respiratory needs. During exhale the valve is closed and no air flows from the air source to conserve compressed air supplies.

Demand valves have been in general use for many years in SCUBA Diving Equipment, SCBA—Self Contained Breathing Apparatus for Fire Fighting, Aviators Oxygen Breathing Systems and so forth. The usual design consists of an air valve with the actuating mechanism connected to a flexible diaphragm that reacts to small pressure changes within the face mask. When the person wearing the mask inhales, the pressure within the face piece is reduced below the ambient outside pressure, this differential pressure is sensed by the demand valve and the valve opens sufficiently to bring the pressure within the face piece back to ambient pressure and shuts off air flow. With the prior art valve systems some physical inhaling effort is required by the mask wearer to obtain air. Under hard work conditions this extra effort can become very tiring and for this reason there have been many valve designs that have attempted to reduce the amount of effort required to actuate the valve. Two different methods are generally employed to reduce the effort required to actuate the valve.

One method is to reduce to a minimum the amount of force required to actuate the valve by designing into the valve several stages of pressure control and by balancing the air forces with spring mechanisms. This method works well but requires many precision components, careful set up, adjustments, and repeated maintenance adjustments to keep it operating correctly.

The other method is to let the flow of air through the valve body act as a boot strapping effect to assist in opening the valve. This has been employed in the past by deflecting all or part of the air entering the valve towards the outlet opening which by venturi effect helps to draw in the diaphragm which in turn decreases the effort required from the mask wearer.

SUMMARY OF THE INVENTION

The demand valve of this invention eliminates the problems discussed above by providing an improved demand valve which combines the venturi effect described in the immediate above paragraph with a valve actuating arm which under force of the inlet air directly acts upon an air valve to maintain air flow into the respirator mask without excessive effort by the user. When inhaling stops, a positive pressure is formed in the face piece against the diaphragm and actuating arm which allows the air valve to close. A spring may be included between the outer valve housing shell and the diaphragm. The spring causes a positive air pressure to be maintained on the face piece side of the diaphragm to counter act its effect on the diaphragm. Positive air pressure prevents leaking of surrounding ambient air into the mask. This type valve is known as a "pressure" demand valve.

If the spring between the housing and diaphragm is removed from the valve, the valve becomes a "non-pressure" demand valve. This type of valve would allow air into the mask only on demand as the wearer inhales and differs from a pressure demand valve only in that it does not require positive air pressure to be maintained within the mask against the diaphragm to counteract the force of the spring on the diaphragm.

Accordingly, it is an object of this invention to provide a novel demand valve for a respirator.

Another object of this invention is to provide for a demand valve for a respirator which is of simple construction.

Another object of this invention is to provide for a demand valve for a respirator which is of effortless and reliable operation.

Other objects of this invention will become apparent upon a reading of the following description taken with the accompanying drawings.

DESCRIPTION OF THE PREFERRED EMBODIMENTS

The preferred embodiments herein described are not intended to be exhaustive or to limit the applications to the precise forms disclosed. Rather they are chosen and described in order to explain the invention to enable others skilled in the art to utilize its teachings.

Figure 1:
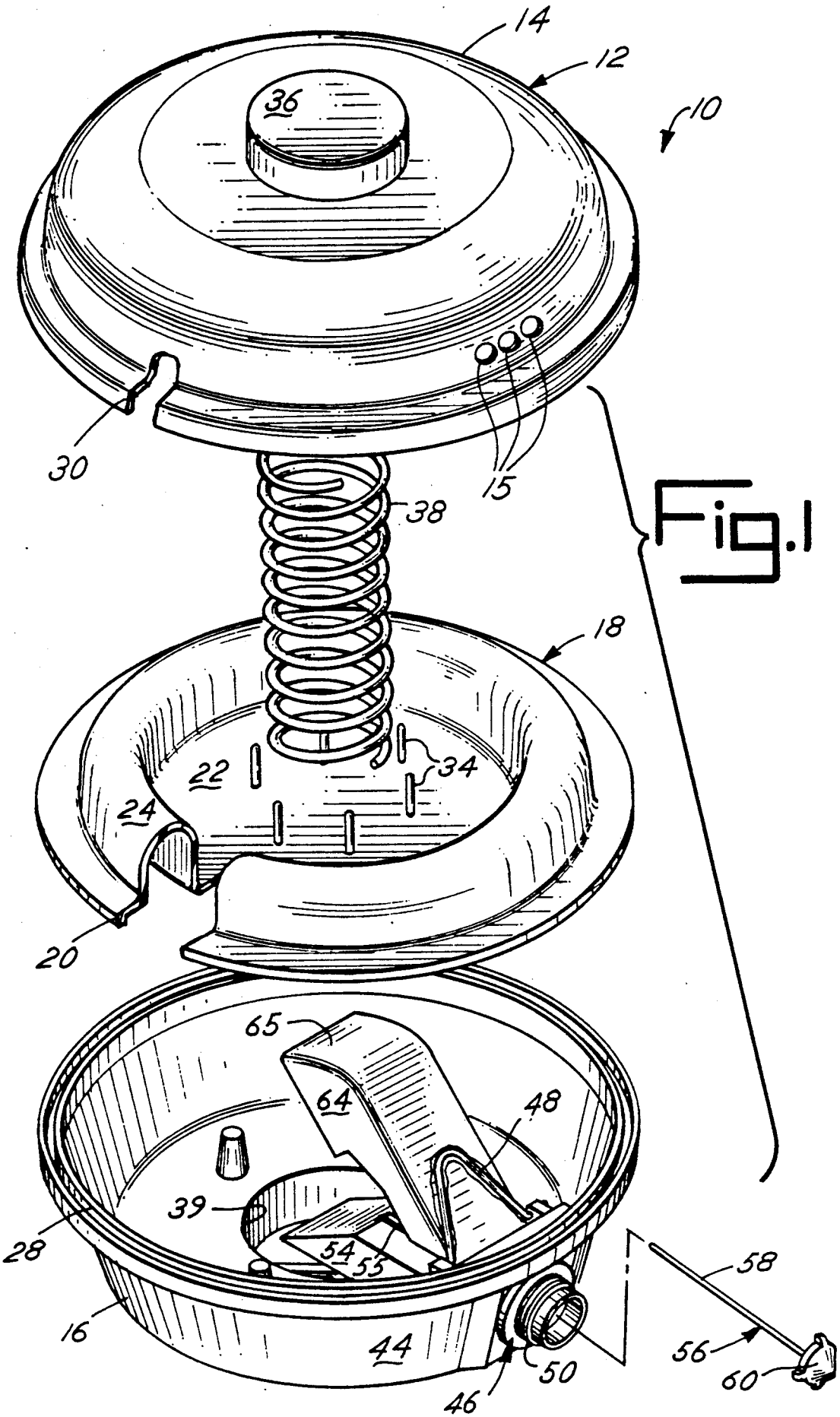
FIG. 1 is an exploded view of the pressure demand valve of this invention.
Figure 2:
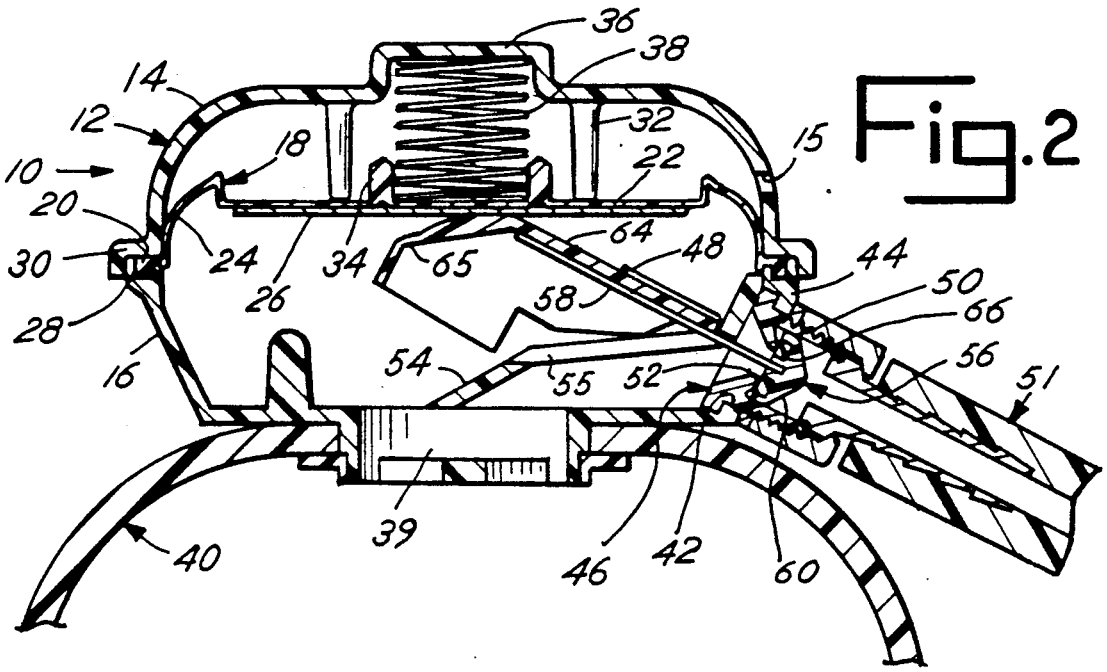
FIG. 2 is a cross sectional view of the valve in a closed position.

Referring now to the drawings, FIGS. 1-4 and 8 illustrate valve 10 as including a two piece plastic housing 12 formed from outer part 14 and inner part 16 relative to face mask 40, only partially shown in FIG. 2. A flexible diaphragm 18 having a peripheral lip 20 and a central portion 22 interconnected by an annular portion 24 formed in a normal inverted U-shape is carried by housing 12 between parts 14, 16. A rigid plate 26 is attached to diaphragm central portion 22. Peripheral lip 20 of the diaphragm is seated within an annular groove 28 of inner housing part 16. Outer housing part 14 includes vent openings 15 and an annular flange 30 which as illustrated overlies the outer edge of housing part 16 and groove 28, and is bonded to housing part 12 to retain diaphragm lip 20 within the groove. Diaphragm 18 divides housing 12 into a clean air side and an ambient air side in which the term "clean air" refers to air from the breathable pressurized air source (not shown) coming through air inlet 42 and into face piece 40. (shown only partially) in FIG. 2. Outer housing part 14 includes projections 32 extending inwardly toward diaphragm 18. Projections 32 define the outer deflection limit of the diaphragm. Outer housing part 14 further includes an internal recessed portion 36. A plurality of locating projections 34 extend from center portion 22 of diaphragm 18 toward outer housing part 14. A helical spring 38 extends in slight compression between outer housing part recessed portion 36 and diaphragm central portion 22 within projections 34 which assist in maintaining spring 38 in alignment.

Housing part 16 includes a central opening 39 opposite diaphragm 22 and provides the connection to face piece 40 shown fragmented in FIG. 2 only. Opening 39 serves as an outlet for air to pass between valve 10 and face piece 40. An air inlet 42 is formed in side wall 44 of housing part 16. A valve housing 46 having an externally threaded shank 50 is seated in inlet 42 and includes an internal valve seat 52 as illustrated.

A fixed air tube 54 extends from inlet 42 to opening 39 for directing air flow from inlet 42 into the face piece. As illustrated tube 54 includes a longitudinal slot 55 facing diaphragm 22. A three sided actuating arm 64 rigidly shaped as illustrated overlies slot 55 in tube 54 and is pivotally connected to housing part 16 by pin 48 adjacent inlet 42. Arm 64 as illustrated in its longitudinal section has an end wall 65 oppositely located from pivot pin 48 to direct the air exiting tube 54 through slot 55 out opening 39 in the housing.

A valve 56 is located in valve housing 46 and includes a valve stem 58 and a head 60. Valve head 60 is generally conical in shape. An O-ring 66 is seated within valve head 60 for contacting seat 52. Stem 58 of valve 56 extends through slot 55 of tube 54 and engages the inner side of lever 64 as illustrated in the figures.

In use, the valve 10 of FIGS. 1–4 is connected to the pressurized air source by the threaded shank 50 of valve housing 46 and a hose 51 as is common in the industry. Air pressure exerted against the valve head 60 by the air source urges valve head 60 to firmly and evenly seat on valve seat 52 to prevent air flow into the housing. Stem 58 extends coaxially from valve housing 46 as illustrated in FIG. 2. Actuating arm 64 is supported in an elevated position by stem 58 in contact with plate 26 of diaphragm 18. Spring 38 places a slight force against diaphragm 22 to deflect the diaphragm central portion 22 which causes arm 64 to pivot toward the outlet. Arm 64 pushes against valve stem 58 to unseat head 60 a small amount to allow a small amount of air flow into the housing clean air side to counteract the effect of spring 38 on diaphragm 18. The amount of pressure built up equals the spring pressure to maintain the valve slightly open. The buildup of air pressure on the clean air side of housing 12 is referred to as positive pressure and prevents the seepage of ambient air into the mask and clean air side of the housing.

Figure 3:
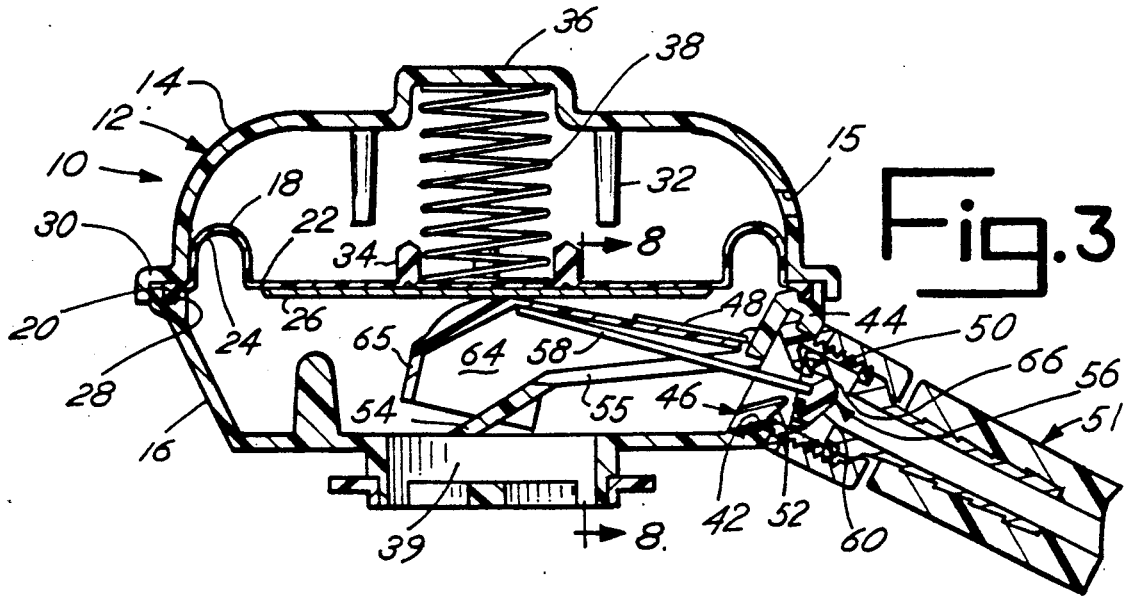
FIG. 3 is the view of FIG. 2 with the valve in the partially open position.

When the user starts to inhale, the positive air pressure on the clean air side of the diaphragm 18 is released and the diaphragm moves rapidly further toward face piece 40 and pushes against arm 64. Arm 64 correspondingly pushes against valve stem 58 which causes valve head 60 to substantially unseat, permitting a substantial amount of pressurized air to flow from inlet 42 through air tube 54 and opening 39 to the face piece 40 for intake by the wearer. Pressurized air traveling through tube 54 into opening 39 creates a low pressure area in the clean air side of the valve consistant with the venturi effect. The low pressure causes the central portion 22 of diaphragm 18 to deflect toward opening 39. A portion of this pressurized air exits tube 54 through slot 55 and is directed along arm 64 downwardly over tube 54 toward the face piece. Due to Bernoulli's principle as commonly understood, air traveling through arm 64 creates a low pressure area within the arm above tube 54. This low pressure area forces the arm 64 toward opening 39 to urge valve 56 towards its open position as seen in FIG. 3. This movement of arm 64 holds the valve in its open position to continue the supply of air to the wearer without continued effort on the user's part. The movement of arm 64 consistent with Bernoulli's principle is similar to lift generated by an airplane wing wherein the wing moves toward the low pressure area of its upper surface. The inclusion of arm 64 requires less effort on behalf of the user to initiate air flow due to its direct association with the valve stem. Decreased user effort translates into a smaller fatigue factor during extended use of a respirator. When the wearer stops inhaling, positive pressure builds up on the clean air side of the diaphragm with the diaphragm, arm and valve returning to the positions shown in FIG. 2 to shut off air flow into the housing. The positive pressure previously mentioned is reestablished on the clean air side of diaphragm 18 as discussed earlier.

Figure 4:
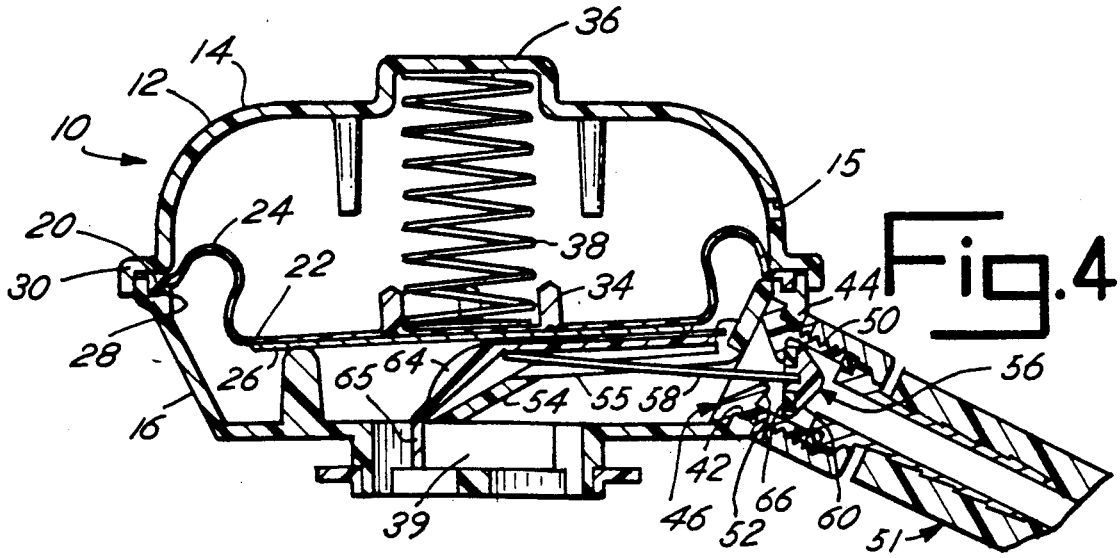
FIG. 4 is the view of FIG. 2 with the valve in the full open position.

FIG. 4 illustrates the valve in a fully open position with arm 64 substantially parallel to the diaphragm central portion 22. The position of FIG. 4 is illustrated only to show the full range of movement for the valve 60 and arm 64. In use, neither the valve, arm, or diaphragm would typically be positioned as illustrated as the rate of air flow to the wearer would be too great for consumption.

Figure 5:
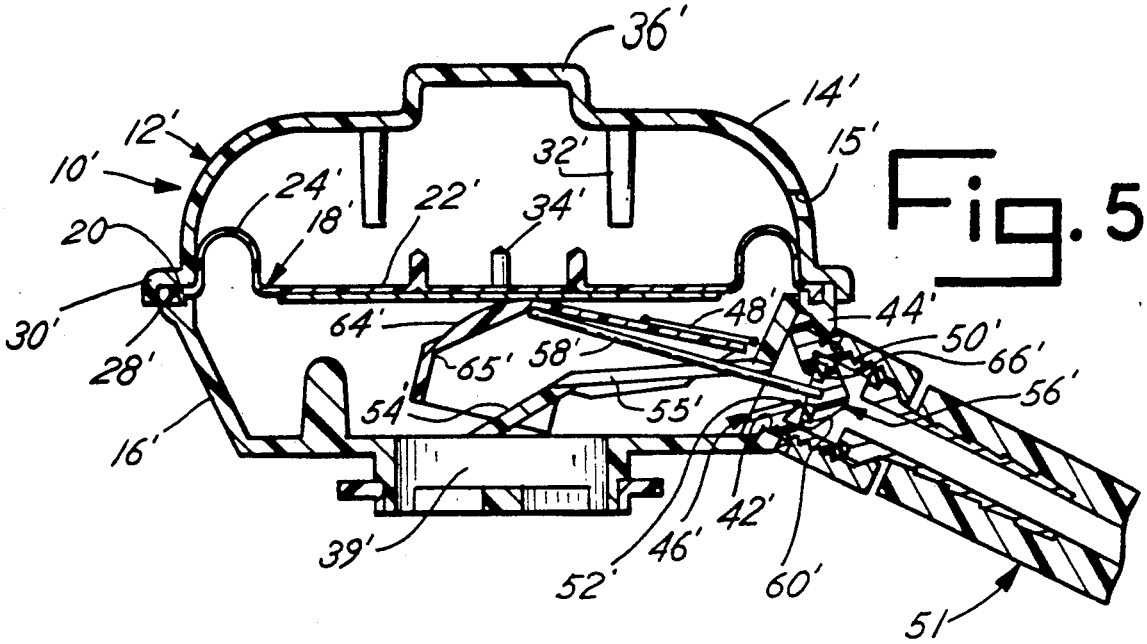
FIG. 5 is a cross sectional view of a non-pressure demand valve of this invention in its operating position.

A second embodiment of the valve of this invention is illustrated in FIG. 5. The valve 10' of FIG. 5 is constructed identical to valve 10 of FIGS. 1–4 and 8 except for the exclusion of the spring 38 between diaphragm 18' and outer body part 14'. In operation, as with the first embodiment, pressure against valve head 60' causes the valve to seat on valve seat 52' and stem 58' to extend through tube slot 55' essentially coaxially with the valve housing 46'. The diaphragm 18' is normally in an at rest position deflected slightly upwardly by arm 64' as pressure on each side of the diaphragm is equal. When the wearer inhales, pressure on the clean air side of the diaphragm 18' is reduced which causes the center portion 22' of the diaphragm to deflect toward the clean air side (see FIG. 5). Plate 26' attached to the diaphragm 18' contacts arm 64' which pushes against valve stem 58' to unseat the valve head 60' and permit airflow into the face piece (not shown) through air tube 54'. As before, a portion of the air flow through tube 54' exits slot 55' and along arm 64' toward the face piece (not shown) creating a low pressure area within the arm. This low pressure area forces arm 64' toward opening 39' to hold the valve open without continued effort on behalf of the wearer. When the wearer stops inhaling, the pressure on the clean air side of diaphragm 18' returns to ambient allowing the diaphragm to deflect into its normal position near outer housing part 14'. As diaphragm 18' deflects nearer outer housing part 14', arm 64' shifts under force of valve stem 58' as urged by air pressure against valve head 60' to allow the valve to completely seat and shut off air flow to the housing.

Figure 6:
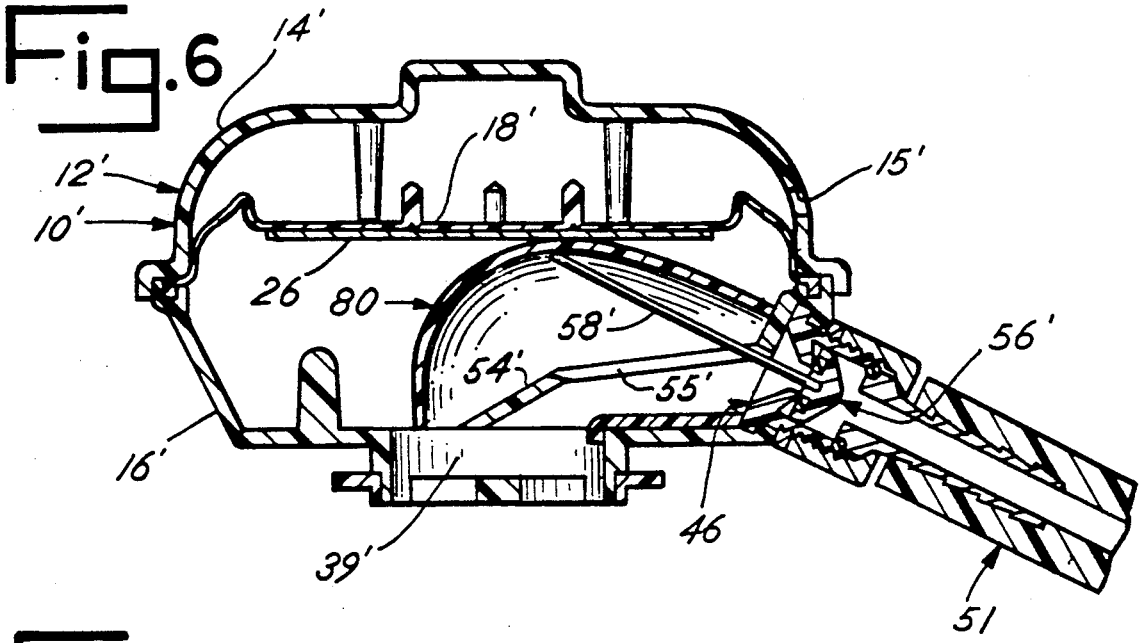
FIG. 6 is a cross sectional view of a non-pressure demand valve of this invention in its closed position using a modified valve actuator.
Figure 7:
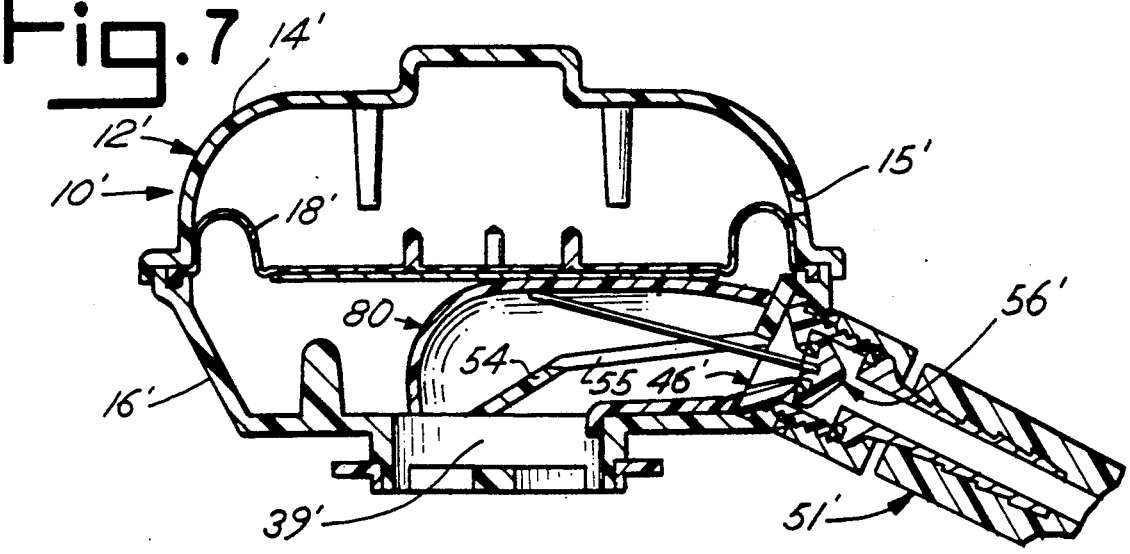
FIG. 7 is the view of FIG. 6 with the valve partially open.
Figure 8:
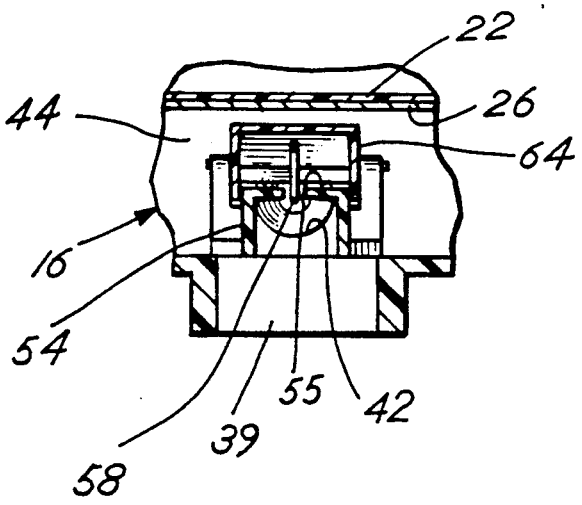
FIG. 8 is a fragmented cross sectional view taken from line 8—8 of FIG. 3.

An alternative structure to the pivotally connected rigid arm 64 and 64' is illustrated in FIGS. 6 and 7. The arm of FIGS. 1–5 and 8 is replaced by a semi-rigid boot 80. As pressure within the boot decreases due to the effect of Bernoulli's principle with partial air flow through tube slot 55 as described above, the boot collapses against the valve stem to hold the valve open (see FIG. 7).

In each of the described embodiments, air from the pressurized air sources is divided into two parts entering the demand valve. A portion passes through air tubes 54 and a portion passes through slots 55 in the air tubes as the air exits opening 39.

It should be understood that the vent openings in outer housing part of each embodiment permits the free flow of air into and out of the ambient side of the diaphragm to permit the diaphragm to freely move in the manner described above.

It should be further understood that the invention is not to be limited to the precise forms disclosed but may be modified within the scope of the appended claims.

I claim:

1. A demand valve for connection between a pressurized air source and a face piece for supplying pressurized air from said source to said face piece responsive to inhalation by a wearer of said face piece, said valve including, a housing defining an interior chamber, a diaphragm spanning said housing and separating said interior chamber into first and second sub-chambers, said first sub-chamber having an outlet for connection to said face piece and said second sub-chamber vented to the surrounding environment, a valve means carried by said housing in air flow communication with said first sub-chamber for communication to said pressurized air source, said valve means being shiftable between a closed position preventing air flow from said source into said first sub-chamber and an open position allowing air flow from said pressurized air source into said first sub-chamber, shiftable actuating means in said first sub-chamber below said diaphragm responsive to movement of said diaphram upon inhalation by said face piece user for initially opening said valve means, said actuating means responsive to contact by said airflow for creating thereat an area of low pressure to shift the actuating means and further open said valve means.

2. The demand valve of claim 1 and tube means connected in flow communication with said valve means for directing a portion of said air flow from said valve means through said first subchamber outlet.

3. The demand valve of claim 2 wherein said tube means includes opening means for directing another portion of said air flow toward said actuating means.

4. The demand valve of claim 3 wherein said valve means includes a valve seat carried by said housing and a pivotal valve head in contact with said valve seat, a valve stem extending from said valve head through said opening means into said first subchamber, said actuating means contacting said valve stem and shifting in response to said first mentioned portion of air to separate said valve head from said valve seat.

5. The demand valve of claim 4 wherein said actuating means includes an three sided arm pivotally connected with said first subchamber over said opening means and valve stem wherein said another portion of said air flow flowing from said opening means along said arm causes the arm to pivot against the valve stem to separate said valve head from said valve seat.

6. The demand valve of claim 4 wherein said actuating means includes a flexible open ended tube surrounding said tube means and valve stem wherein said another portion of said air flow flowing along the interior of said tube cause the tube to collapse against said valve stem to separate said valve head from said valve seat.

7. A method for providing pressurized air from a pressurized air source to a face piece worn by a user responsive to the inhalation by a wearer of said face piece, said method including:

a. providing a housing defining a housing defining an interior chamber;

b. providing a diaphragm spanning said housing and separating said interior chamber into said first and second sub-chambers, wherein said first sub-chamber includes an outlet for connection to said face piece and said second sub-chamber being vented to the surrounding environment;

c. providing a valve means carried by said housing in air flow communication with said sub-chamber for connection to said pressurized air source, said valve means being shiftable between a closed position preventing air flow from said source into said first sub-chamber and an opening position allowing air flow from said pressurized air source into said first sub-chamber; and d. providing shiftable actuating means in said first sub-chamber below said diaphragm responsive to movement of said diaphram upon inhalation by said face piece user for initially opening said valve means; said actuating means responsive to contact by said airflow for creating thereat an area of low pressure to shift the actuating means and further open said valve means.

* * * * *

UNITED STATES PATENT AND TRADEMARK OFFICE

CERTIFICATE OF CORRECTION

PATENT NO. : 5,042,473
DATED : August 27, 1991
INVENTOR(S) : Robert D. Lewis

It is certified that error appears in the above-identified patent and that said Letters Patent is hereby corrected as shown below:

On the title page item (75) should read--Robert D. Lewis --.

Signed and Sealed this

Tenth Day of November, 1992

*Attest:*

DOUGLAS B. COMER

*Attesting Officer*

*Acting Commissioner of Patents and Trademarks*